US005980433A

United States Patent [19]

Ramsay

[11] Patent Number: 5,980,433

[45] Date of Patent: Nov. 9, 1999

[54] CALF-SPECIFIC EXERCISER

[76] Inventor: J. Douglas Ramsay, P.O. Box 1397, Goliad, Tex. 77963

[21] Appl. No.: 08/920,650

[22] Filed: Aug. 29, 1997

[51] Int. Cl.[6] ..... A63B 23/08

[52] U.S. Cl. ..... 482/80; 601/29

[58] Field of Search ..... 482/148, 142, 482/79, 80, 908; 601/29–32; 128/845

[56] References Cited

U.S. PATENT DOCUMENTS

| | | | |
|---|---|---|---|
| 3,598,404 | 8/1971 | Bowman | 482/80 |
| 4,111,416 | 9/1978 | Jinotti | 482/80 |
| 4,279,415 | 7/1981 | Katz | 482/80 |
| 4,452,449 | 6/1984 | Propst | 482/79 X |
| 4,693,470 | 9/1987 | Ogawa | 482/79 |
| 4,694,684 | 9/1987 | Campbell | 482/80 X |
| 4,862,875 | 9/1989 | Heaton | 482/79 X |
| 5,087,036 | 2/1992 | Cooper | 482/79 |
| 5,186,700 | 2/1993 | Wang | 482/80 X |
| 5,267,924 | 12/1993 | Miller | 482/79 |
| 5,304,105 | 4/1994 | Hsieh | 482/80 X |
| 5,645,516 | 7/1997 | Foster | 482/79 |

FOREIGN PATENT DOCUMENTS

| | | | |
|---|---|---|---|
| 2084029 | 4/1982 | United Kingdom | 482/79 |

*Primary Examiner*—Richard J. Apley
*Assistant Examiner*—William LaMarca

[57] ABSTRACT

The invention provides a calf exerciser which safely duplicates the desirable aspects of stair-edge toe lifts. The present exerciser allows a user to transition from a fully contracted position (a "tip-toe" stance) to a fully extended position (much as if one's heels were dropped below the level of the stair on which one rests his or her forefoot to the extent allowed by the exerciser's flexibility). A pivoting forefoot plate pivots with the user's forefoot as he or she transitions between the extended and contracted limits of the toe lift cycles. This eliminates the presentation at any phase of the exercise cycle of a sharp edge (like a stair-edge) to the foot, as well as insures that the user's forefoot (or corresponding shoe portion) remains squarely and safely in contact with a stable surface, despite inherent rocking motion of the feet during each toe lift cycle. The forefoot plate is biased toward the position for the extended phase of a toe lift exercise, so that the transition through the exercise is smooth and safe, and to provide a bit more resistance when transitioning toward the contracted phase of the exercise.

3 Claims, 3 Drawing Sheets

CALF-SPECIFIC EXERCISER

BACKGROUND OF THE INVENTION

1. Field of the Invention

Applicant's invention relates to apparatuses used to facilitate physical conditioning of the human body or specified portions thereof.

2. Background Information

The recent emergence of exercise devices which are designed to target specific body regions (the abdomen, the back, the buttocks, etc.) reflect the fact that no single exercise device will suffice for toning all areas of the body which people tend to target through exercise.

Toning and shaping the calf muscles is one activity for which there remains a need for an optimal exercise apparatus. There are a number of activities in which a person may participate for toning and shaping the calf muscles. These include simple toe lifts on a flat surface, extended toe lifts while facing a stair with one's heels extending beyond the edge of the stair, and bicycle riding. In the case of calf conditioning through flat-surface toe lifts, progress is very slow, impeded by the limited range of motion permitted by the flat surface. Many things potentially stand in the way of using bicycle riding to condition calves—availability of a bicycle, weather, lack of a safe area to ride, etc. Furthermore, bicycle riding does not promote a full range of motion for the calf muscles and is, therefore, an inferior form of exercise in the specific context of calf muscle toning and shaping.

Safety and/or comfort are issues negatively reflecting on calf conditioning through extended toe lifts performed on a stair-edge. If one stands bare or sock-footed on a stair-edge, the narrowly focused pressure of the edge of the stair on the arch area of the foot can be quite painful, particularly during the extension phase of the toe lift. Conversely, wearing a shoe may help in alleviating discomfort, but increases the quite dangerous probability of slipping from the stair(s) with a resulting potentially serious injury.

Other considerations bearing on the design of an exercise device relate to convenience in moving from storage to use environment, size and weight, transportability (for users who are business travelers, for example), and mechanical simplicity and reliability.

The present inventor is unaware of any device which provides both safe and highly effective calf muscle toning and shaping, is compact, is easily transported, is mechanically simple, and inexpensive to manufacture (and, presumably, to purchase).

In view of the above, it would be desirable to provide the public with a calf exercise device which satisfied each of the characteristics of: (1) providing safe and effective calf muscle conditioning and shaping; (2) being small and lightweight for easy handling and transportation; and (3) being of simplistic design for affording cost effective manufacture and desirable purchase price factors.

SUMMARY OF THE INVENTION

It is an object of the present invention to provide a novel calf exercise device.

It is another object of the present invention to provide an exercise device that affords more effective calf muscle toning and shaping than conventional, non-apparatus assisted calf toning and shaping exercises.

It is another object of the present invention to provide an exercise device that affords a safer methodology for calf muscle toning and shaping than stair-edge like toe lift exercises.

It is another object of the present invention to provide an exercise device that affords a safe methodology for improved calf muscle tone, shaping and symmetry.

It is another object of the present invention to provide a novel calf exerciser which is small and lightweight, yet highly effective.

In satisfaction of these and related objectives, Applicant's present invention provides a calf exerciser which safely incorporates, but improves upon the desirable aspects of presently known, stair-edge type toe lift exercises. The present exerciser allows a user to transition from a fully contracted position (a "tip-toe" stance) to a fully extended position (much as if one's heels were dropped below the level of the stair on which one rests his or her forefoot to the extent allowed by the exerciser's flexibility). A pivoting forefoot plate pivots with the user's forefoot as he or she transitions between the extended and contracted limits of the toe lift cycles. This eliminates the presentation at any phase of the exercise cycle of a sharp edge (like a stair-edge) to the foot, as well as insures that the user's forefoot (or corresponding shoe portion) remains squarely and safely in contact with a stable surface, despite the inherent rocking motion of the feet during each toe lift cycle. The forefoot plate is biased toward the position for the extended phase of a toe lift exercise, so that the transition through the exercise is smooth and safe, and to provide a bit more resistance when transitioning toward the contracted phase of the exercise.

A large and bulky embodiment of the present invention is certainly possible, and, for health club-type uses, perhaps even desirable. However, the preferred embodiment of the present calf exerciser is one which is rather small, easily made lightweight, and is mechanically very simple. The size and weight of the preferred embodiment of the exerciser well suits it for travelers, or for users who would like to be able to slip the device under a bed, or into a closet between uses.

The simplicity of design, and small quantity of materials required for the exerciser makes possible a very low manufacturing cost, with a potentially low purchase price for ultimate consumers.

DETAILED DESCRIPTION OF THE PREFERRED EMBODIMENT

Figure 1:
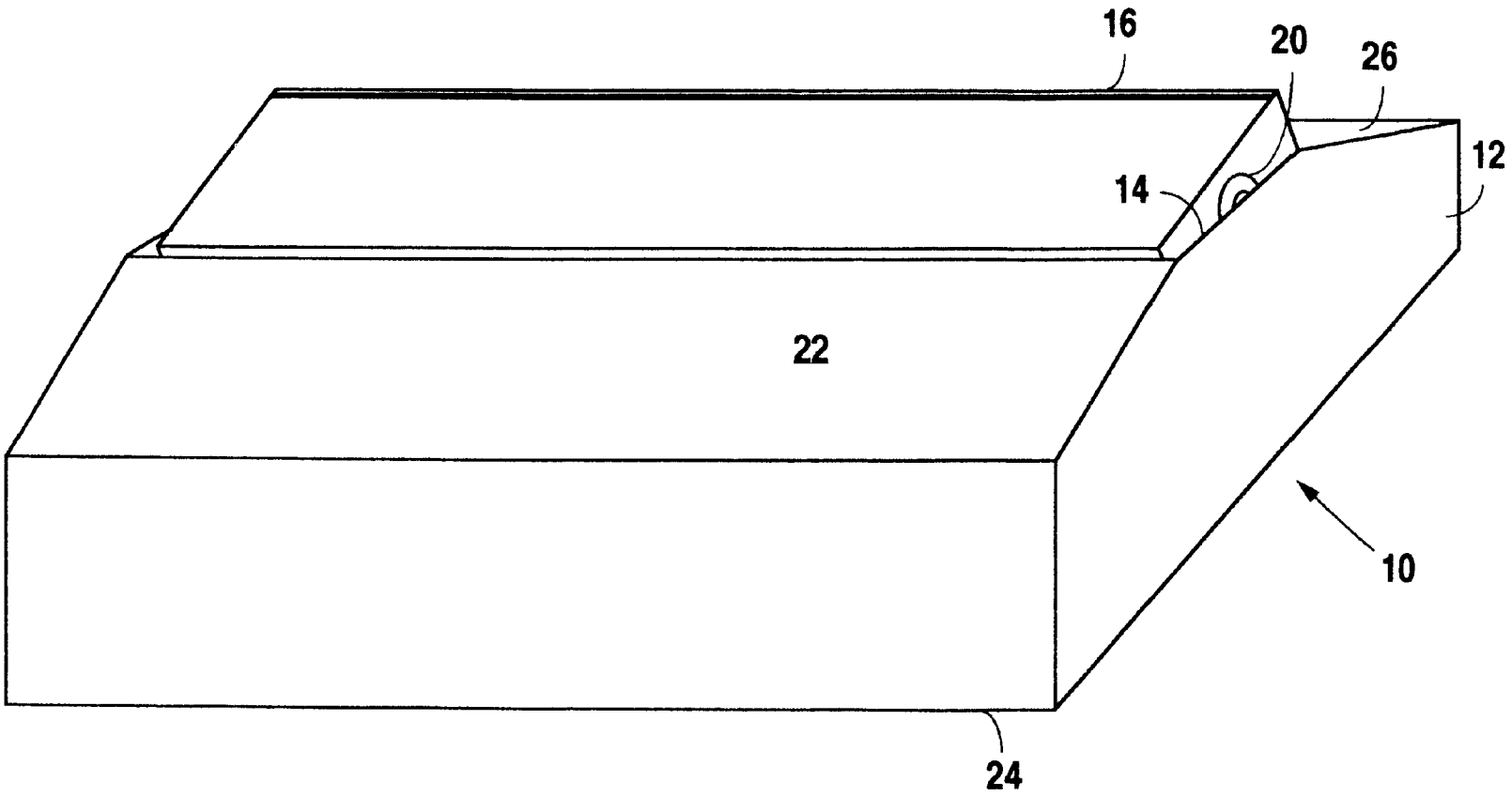
FIG. 1 is a perspective view of the preferred embodiment of the present calf exerciser.

Referring to FIG. 1, the calf exerciser of the present invention is identified generally by the reference numeral 10. Calf exerciser 10 includes a chassis 12 which may be formed of any suitably durable material, such as high impact plastic or even sheet metal. Chassis 12 is a substantially hollow structure with the stationary surfaces shown in FIG. 1 being outer walls which define an interior hollow.

Positioned in an elongate opening 14 is a pivotal forefoot plate 16. Forefoot plate 16 pivots or rocks on an axle 18 which is carried on either end by a raced roller bearing 20.

Figure 2:
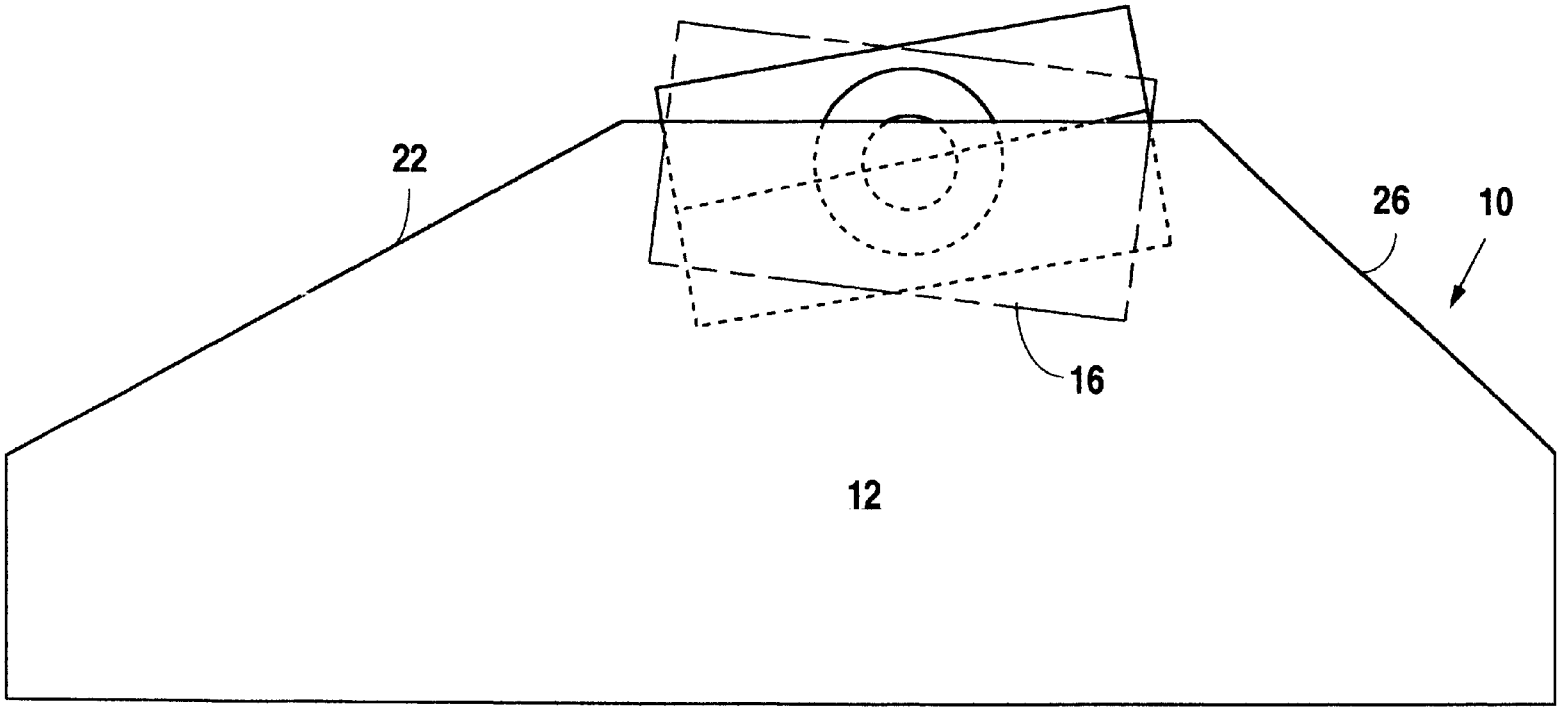
FIG. 2 is a side elevational view of the exerciser of FIG. 1, depicting the range of motion for forefoot plate 16, shown partially by phantom lines.

Referring in combination to FIGS. 1 and 2, the contours of chassis 12 as well as the range through which forefoot plate 16 pivots are central elements of the present invention. Integral to chassis 12 in the preferred embodiment of the present invention is a heel plate 22. The planer surface of heel plate 22 is oriented at approximately 29° relative to horizontal (defined by the lower edge 24 of chassis 12).

Figure 3:
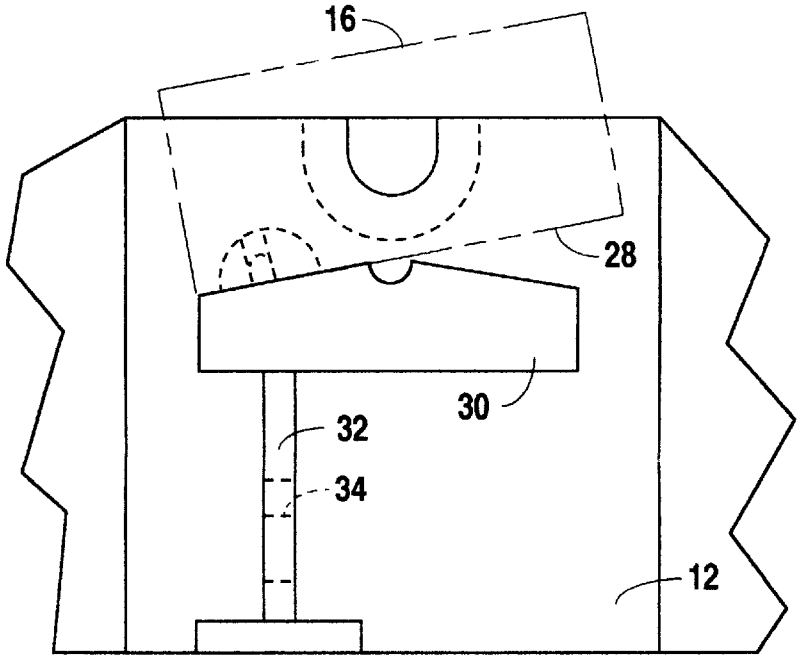
FIG. 3 is a partial elevational, cross sectional view of the exerciser of FIG. 1 depicting the interaction between forefoot plate 16 and forefoot plate stop 30.

Referring in combination to FIGS. 1, 2, and 3, forefoot plate 16 is positioned within opening 14 and carried by bearings 20 such that it pivots (see FIG. 2 for an indication of the range of motion for forefoot plate 16). A forefoot plate stop 30 is positioned inside chassis 12 and is contoured to abut the lower side 28 of forefoot plate 16 as it reaches each limit of its pivotal motion.

In the preferred embodiment, forefoot plate 16 pivots about bearings 20 through an approximately 19° range of motion. Forefoot plate 16 is further positioned relative to chassis 12 whereby the rearward margin 24 of forefoot plate 16 closely juxtaposes the adjacent margin of chassis 12 when forefoot plate 16 is pivoted to its extension limit (the position for forefoot plate 16, such as shown in FIG. 3, when a user, whose forefeet are properly placed on the forefoot plate 16, has lowered his or her heels onto the heel plate 22 to extend their calf muscles to the extent permitted by the contouring of chassis 12 and forefoot plate 16). When forefoot plate 16 is in its extension limit position, the upper surface (or "forefoot contact surface") is oriented approximately 11.5° relative to the horizontal, with the rearward edge of footplate 16 being closely juxtaposed to the adjacent chassis margin which, in part, defines opening 14. Conversely, when forefoot plate 16 is pivoted to its opposite limit (the "contraction limit", where a user is in the most "tip toe" like stance [shown in phantom in FIG. 2]) forefoot plate 16 defines an approximately 7.5° angle past the horizontal in the opposite direction from that of the expansion limit.

As is clear from the drawings, the inclination of heel plate 22 is elemental to allowing a user to reach a beneficial degree of extension for the calf muscles. Substantially less inclination would prevent an exerciser from providing a substantial benefit for calf conditioning over that of simple flat floor surface, because the range of motion toward the extension limit would be quite limited as in the case of a flat or nearly flat surface. Conversely, a substantially greater degree of inclination would duplicate the elements of discomfort and safety which attend the use of stairs for toe lift exercises as discussed above—a sharp edge would be presented to the foot, and the severe inclination of the surface would create a slipping hazard for the user.

The rearward face 26 of chassis 12 is inclined downward (from the perspective of the user) at an approximately 45° or greater angle. This insures that the rearward face 26 does not interfere with the movement of a user's forefeet when transitioning toward the contracted limit.

Figure 4:
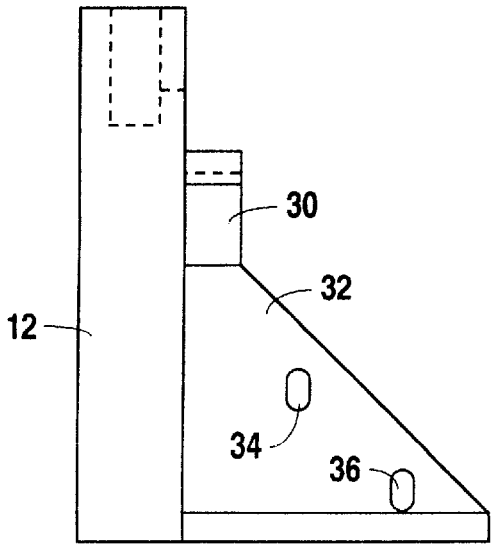
FIG. 4 is a partial elevational, cross sectional view of the exerciser of FIG. 1 depicting the chassis spring anchor.

Referring to FIGS. 3 and 4, a chassis spring anchor 32 is positioned interior of chassis 12 and anchors the lower end of a spring (not visible in the drawings) which extends from either spring hole 34 or 36 in chassis spring anchor 32 to forefoot spring anchor 38. The two spring holes 34 and 36 are provided to allow differing levels of tension on the spring to achieve differing levels of resistance to movement of forefoot plate 16.

Use of exerciser 10 is straight-forward. While standing, one places his or her forefeet on forefoot plate 16 (essentially placing the "balls" of the feet at the mid-point of the width of forefoot plate 16), and allows the heels to overlie heel plate 22. By contracting and extending the calf muscles and thereby rocking forefoot plate 16 cyclically between its range of motion limits, the forefeet remain safely in contact with forefoot plate 16 while still performing valuable exercise and conditioning for the calf muscles. The action of the spring smooths motion between these limits and prevents sudden shifts of position with an associated danger of falling, but also provides additional resistance to overcome or work against in moving toward the contracted phase of the exercise.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A calf exerciser comprising:

a chassis having a base, a lower margin of which defines a first plane, said base for aligning said chassis with a substantially planer surface upon which said chassis may be placed, said chassis having a stationary heel plate an outer heel plate surface of which substantially defines a second plane which is upwardly inclined relative to said first substantially planner surface, said outer heel plate surface of said heel plate rising from a rearward heel plate edge which is most closely adjacent to the rearward margin of said chassis toward the medial, more forward portions of said chassis; and a forefoot plate pivotally supported at a pivot point substantially along a medial axis of said forefoot plate by said chassis where said pivot point is spatially fixed relative to said chassis, said forefoot plate being pivotable relative to said chassis between first and second limits for pivoting substantially in parallel with the range of motion of a user's forefeet which are placed on said forefoot plate as the user flexes and extends the user's calf muscles while respectively raising and lowering the user's heels which overlie said heel plate surface, said forefoot plate, when pivoted to said first limit, being downwardly inclined from the rearward toward the forward margins of said chassis and relative to said first plane and, when pivoted to said second limit, being upwardly inclined from the rearward toward the forward margins of said chassis and relative to said first plane.

2. The invention of claim 1 wherein said inclination of said heel plate relative to said lower margin of said chassis is such that said first and second planes are oriented at approximately 30 degrees relative to each other.

3. The invention of claim 1 wherein the surface of said forefoot plate, when pivoted to said first limit pivoted to said first limit, defines an approximately 12 degree angular differentiation relative to said first plane, and, when pivoted to said second limit, defines an approximately 8 degree angular differentiation relative to said first plane and an approximately 20 degree angular differentiation relative to said first orientation of said forefoot plate.

* * * * *